United States Patent [19]

Rochman

[11] Patent Number: 4,793,165

[45] Date of Patent: Dec. 27, 1988

[54] PROTECTIVE DEVICE FOR KEY-OPERATED DOOR LOCKS

[76] Inventor: Henri Rochman, Levontin St. 4, Natanya 42318, Israel

[21] Appl. No.: 60,180

[22] Filed: Jun. 10, 1987

[30] Foreign Application Priority Data

Jun. 19, 1986 [IL] Israel ..... 79153

[51] Int. Cl.[4] ..... E05B 17/14

[52] U.S. Cl. ..... 70/284; 70/425

[58] Field of Search ..... 70/423, 455, 425, 284, 70/285, 371, 440, 443, 426, 427

[56] References Cited

U.S. PATENT DOCUMENTS

| | | | |
|---|---|---|---|
| 56,394 | 7/1866 | Felter | 70/425 |
| 1,477,432 | 12/1923 | Donzero | 70/425 |
| 2,001,262 | 5/1935 | North | 70/285 |
| 2,611,259 | 9/1952 | Berry et al. | 70/284 |
| 2,775,112 | 12/1956 | Taylor | 70/425 |
| 3,732,711 | 5/1973 | Albert | 70/425 |

FOREIGN PATENT DOCUMENTS

| | | | |
|---|---|---|---|
| 194025 | 1/1908 | Fed. Rep. of Germany | 70/425 |
| 388158 | 1/1924 | Fed. Rep. of Germany | 70/425 |
| 459194 | 8/1950 | Italy | 70/284 |
| 103307 | 1/1917 | United Kingdom | 70/423 |
| 2089420 | 6/1982 | United Kingdom | 70/455 |

*Primary Examiner*—Lloyd A. Gall

*Attorney, Agent, or Firm*—Benjamin J. Barish

[57] ABSTRACT

A protective device for key-operated door locks, comprises a housing mountable to the door over the keyhole of a lock mounted within the door; a guard plate movable to a blocking position to block access to the keyhole, or to an unblocking position to permit access to the keyhole; and a rotary knob rotatable to a plurality of positions and having markings thereon indicating its position. A transmission mechanism including a plurality of notched code discs is provided between the rotary knob and the guard plate for moving the guard plate from its locking position to its unlocking position when the code discs have been positioned to predetermined coded positions such that further rotation of the knob moves the guard plate from its blocking position to its unblocking position.

16 Claims, 6 Drawing Sheets

PROTECTIVE DEVICE FOR KEY-OPERATED DOOR LOCKS

BACKGROUND OF THE INVENTION

The present invention relates to key-operated door locks, and particularly to a protective device for application over such locks and including a guard plate for blocking access to the keyhole of the lock.

A number of protective devices for door locks have been proposed which include guard plates movable to a blocking position blocking access to the keyhole, or to an unblocking position permitting access to the keyhole. Examples of known devices of this type are described in U.S. Pat. Nos. 33,933, 3,732,711 and 4,365,491, and in German patents Nos. 223481 and 542922. The purpose of such devices is to provide protection against an attempted entry by someone using a key which had been fraudently copied, stolen or lost, or by someone using a master key or attempting to pick the lock. Thus, while such guard plates provide this additional protection, they have not yet come into widespread use because of the substantial inconvenience in operating them, and/or the substantial cost in producing them.

An object of the present invention is to provide a novel protective device of this type but one which is convenient and reliable to operate, and which can be manufactured in volume and at low cost.

BRIEF SUMMARY OF THE INVENTION

According to the present invention, there is provided a protective device for key-operated door locks comprising: a housing mountable to the door over the keyhole of a lock mounted within the door; a guard plate movable to a blocking position to block access to the keyhole, or to an unblocking position to permit access to the keyhole; and a rotary knob rotatable to a plurality of positions and having markings thereon indicating its position. A transmission mechanism is provided between the rotary knob and the guard plate for moving the guard plate from its locking position to its unlocking position. The transmission mechanism includes at least a first and a second code disc coupleable to the rotary knob such that rotating the rotary knob in one direction positions the first code disc according to the end position of the knob, and then rotating the knob in the opposite direction positions the second code disc according to the end position of the knob. The transmission mechanism further includes coupling means controlled by the code discs and effective to couple the guard plate to the rotary knob when the code discs have been positioned to predetermined coded positions such that further rotation of the knob moves the guard plate from its blocking position to its unblocking position.

In the preferred embodiment of the invention described below, the code discs have notches which are aligned with each other when the discs are in their predetermined code positions, and the coupling means comprises an interposer member coupled to the guard plate and having a drive pin receivable in the notches when aligned to cause the further rotation of the knob to move the guard plate to its unblocking position.

As will be described more particularly below, door locking devices may be constructed in accordance with the above features which are convenient and reliable in operation and which can be produced in volume at low cost.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
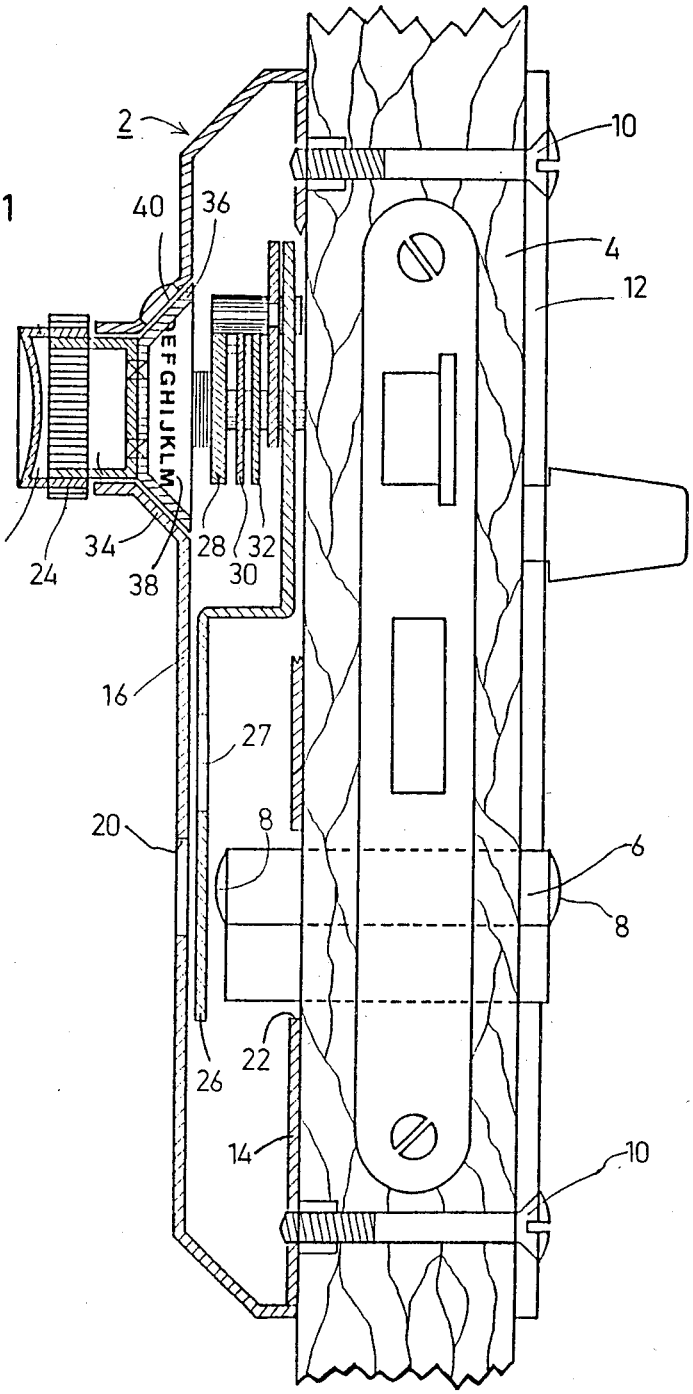
FIG. 1 is a sectional view illustrating a key-operated door locking device constructed in accordance with the present invention and mounted in a door.
Figure 2:
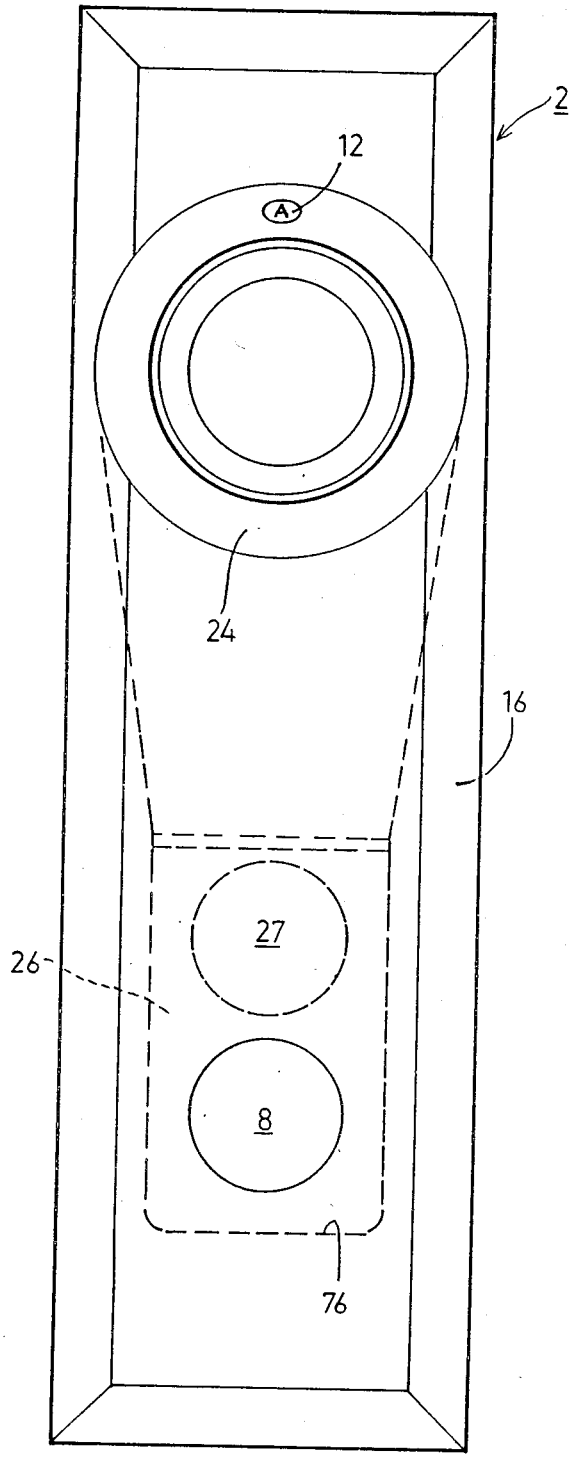
FIG. 2 is a front view of the door locking device of FIG. 1.

The protective device illustrated in FIG. 1 comprises a housing, generally designated 2, mountable to the outer face of the door 4 so as to overlie the lock 6 included in the door. The lock 6 is illustrated as a conventional lock cylinder having a keyhole 8 at its opposite ends for the insertion of a proper key in order to lock and unlock the door.

The protective device is secured to the front side of the door by a plurality of threaded fasteners 10 passing through a mounting plate 12 at the inner face of the door, the door 4 itself, and a rear cover plate 14 of housing 2.

Housing 2 further includes a front cover plate 16 secured to the rear cover plate 14 by fasteners (not shown) passing through nuts 18 (FIGS. 3,4) carried at the opposite ends of the rear cover plate 14. The front cover plate 16 is formed with an opening 20, and the rear cover plate 14 is similarly formed with an opening 22, both in alignment with the lock cylinder 6.

A rotary knob 24 is rotatably mounted in the front cover plate 16 of housing 2, and passes through an opening in the cover plate where it is coupled to a transmission mechanism within housing 2 for moving a guard plate 26 disposed within the housing. Rotary knob 24 includes an outer section 24*a* (FIG. 4) fixed to an inner cylindrical section sectin 24*b* joined to an end wall 24*c*. The transmission between rotary knob 24 and guard plate 26 includes a drive disc 28 fixed to end wall 24*c* of the rotary knob 24, and a pair of code discs 30, 32, which couple drive disc 28 to the guard plate 26 when the code discs have first been preset to predetermined code positions by the rotary knob 24. Guard plate 26 is formed at its lower end with a window opening 27 which, in the normal position of the guard plate, is located above the keyhole 8 of the lock cylinder 6 so that the guard plate blocks access to the keyhole. However, when code discs 30, 32 have been preset to predetermined code positions by the rotation of rotary knob 24, as will be described more particularly below, a coupling is effected between drive disc 28 of the rotary knob 24 and guard plate 26 so that additional rotation of the knob lowers the guard plate to bring its window opening 27 into alignment with keyhole 8 of the lock cylinder 6, thereby providing access to the keyhole.

Figure 3:
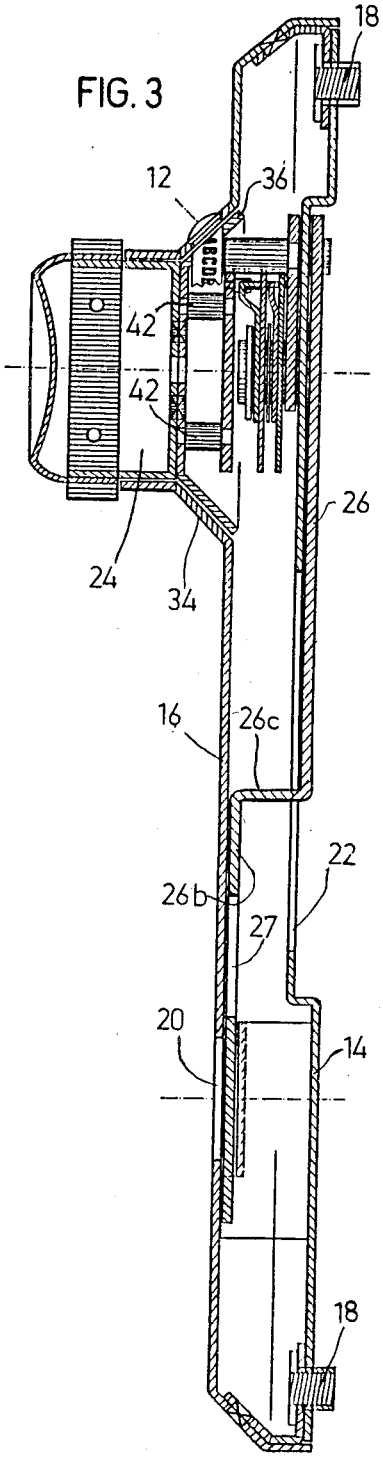
FIG. 3 is a longitudinal sectional view of the door locking device of FIG. 1 removed from the door.
Figure 4:
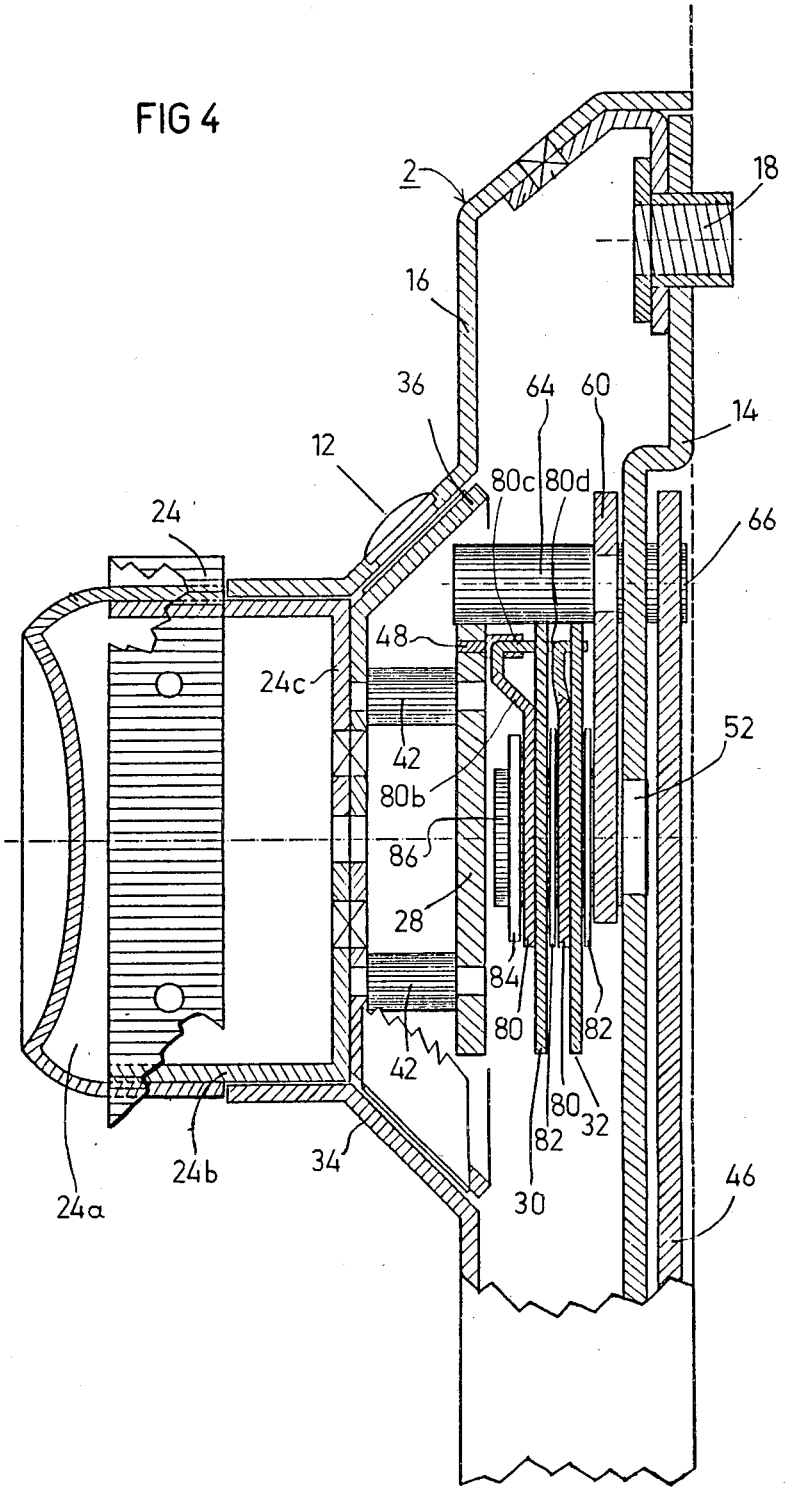
FIG. 4 is an enlarged fragmentary view of a portion of the device of FIG. 3.
Figure 8:
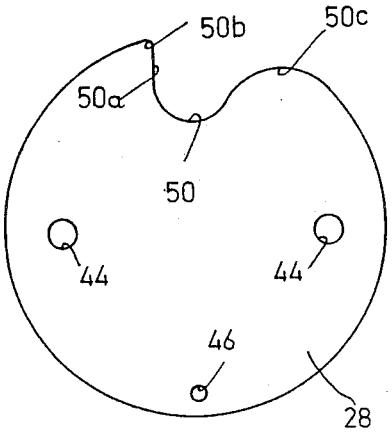
Fig 8 is a front view of the drive disc.

As shown particularly in FIGS. 1 and 3, rotary knob 24 passes through a conical section 34 of the housing front cover plate 16 and is formed with a complementary conical section 36 carrying a plurality of markings 38, such as letters and/or numbers, which are viewable through an opening formed through section 34 of the housing and covered by a lens 40, so as to indicate the rotary position of the knob 24. Drive disc 28 within the housing 2 is attached to end wall **24*c* of rotary knob 24 by a pair of pins 42 (FIG. 4) passing through openings 44 (FIG. 8) in the drive disc. Drive disc 28 includes a further opening 46 for receiving another pin 48 (FIG. 4) which is used for moving the code discs 30, 32. Drive disc 28 is further formed with an edge notch 50 (FIG. 8) having one straight side 50*a* having a rounded tip 50*b*, and a curved side 50*c*. The two code discs 30, 32 are rotatably mounted on a cylindrical spindle 52 secured to the rear cover plate 14 of the housing 2**.

Figure 9:
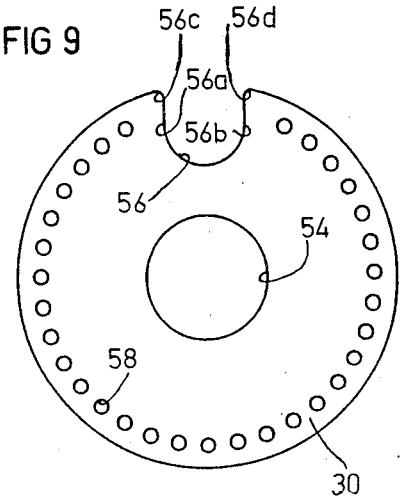
FIG. 9 is a front view of one of the code discs.

FIG. 9 illustrates the construction of code disc 30, it being appreciated that code disc 32 is of the same construction. Thus, as shown in FIG. 9, code disc 30 is formed with a central opening 54 for mounting on spindle 52, and with an edge slot 56 having two parallel straight sides **56*a*, 56*b*, each rounded at their outer tip 56*c*, 56*d*. In addition, code disc 30 is formed with a circular array of openings 58** around its outer periphery.

Figure 10:
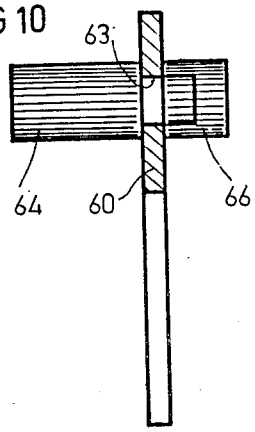
FIG. 10 is a sectional view of the interposer used in the door locking device of FIGS. 1–3.
Figure 11:
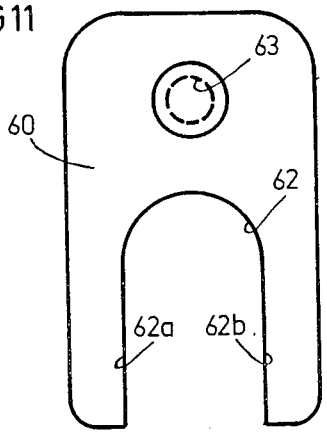
FIG. 11 is a front view of the interposer of FIG. 10.
Figure 12A:
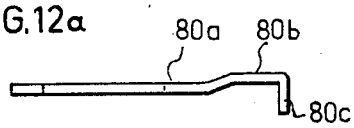
FIG. 12*a* is a front view of one of the presettable members used in the door locking device for presetting the code.
Figure 12B:
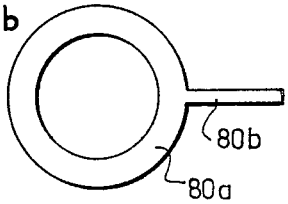
FIG. 12*b* is a longitudinal sectional view of the presettable member of FIG. 12*a;*

Also mounted on spindle 52 is an interposer member 60 whose structure is best seen in FIGS. 10 and 11. Interposer 60 is formed at its lower end with a slot 62 having straight sides **62*a*, 62*b* spaced apart sufficiently to accommodate spindle 52. At its upper end, interposer 60 is formed with an opening 63 for receiving a first pin 64 extending in a direction towards drive disc 28 to overlie its outer circumference, and a second pin 66 extending in the opposite direction towards the rear cover plate 14 and received within a slot 68 (FIG. 5**) formed in the latter plate.

Figure 5:
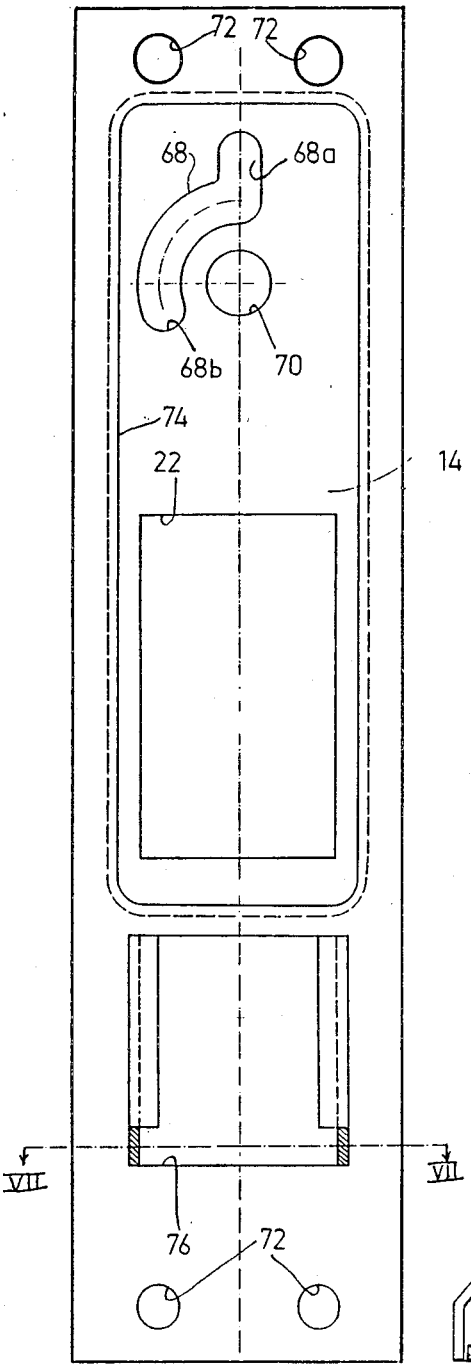
Fig 5 is a rear view of the device of FIGS. 1–3.

As shown in FIG. 5, slot 68 in the rear cover plate 14 is formed at its upper end with a straight vertical section **68*a*, joined to a curved section 68*b* at its lower end. Rear cover plate 14 is further formed with a circular opening 70 for accommodating spindle 52, and with the above-mentioned window opening 22 for accommodating the lock cylinder 6. At its lower end, the rear cover plate 14 is formed with a pair of openings 72 for receiving the threaded fasteners 10**.

The outer face of the rear cover plate 14 is formed with a rib 74 enclosing slot 68 and openings 70 and 22, to define a space for receiving the guard plate 26.

Figure 6:
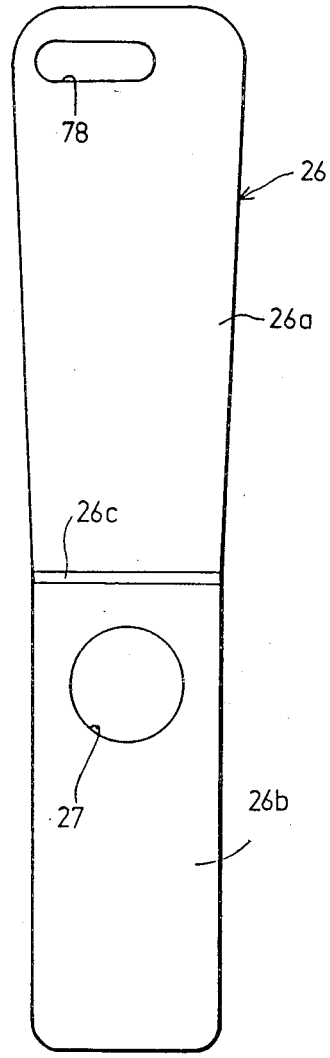
FIG. 6 is a front view of the guard plate included in the device of FIGS. 1–3.
Figure 7:
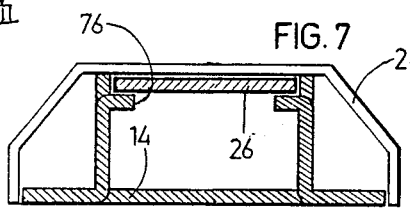
FIG. 7 is a sectional view along line VII—VII of 5.

As shown in FIG. 6, guard plate 26 includes an upper section **26*a* extending along the outer face of the rear cover plate 14 within its rib 74 (FIG. 5, but not shown in FIGS. 1 or 3 for the sake of clarity) and a lower section 26*b*, joined by a bend 26*c*, passing through opening 76 formed in the lower end of rear cover plate 14, so that the lower section 26*b* of the guard plate extends in front of the lock cylinder 6 as shown in FIG. 1. Window 27 of guard plate 26 is formed in this lower section 26*b*. The upper section 26*a* is formed with a horizontal slot 78 for receiving pin 66 (FIG. 10) of interposer 60**.

Each of the code disks 30, 32 is provided with a presettable member 80, best seen in FIGS. **12*a* and 12*b*. Thus, each presettable member 80 includes a ring section 80*a* for application to spindle 52, and an arm section 80*b* bent slightly out of the plane of the ring section 80 and terminating in a down-turned bent tip 80*c* adapted to be received in any selected one of the openings 58 (FIG. 9) in the respective code disc 30, 32. As shown at 80*d* in FIG. 4, the tip 80*c* of presettable member 80 for code disc 30, which is the closer one to the drive disc 28, is of sufficient length so that it is also engageable with the presettable member 80 of the other code disc 32**.

The positions of the presettable members 80 on their respective code discs 30, 32 determine the code of the respective disc. This code may be changed by rotating the respective presettable member to another position wherein its tip **80*c* is received within another one of the holes 58** formed in the respective code disc.

Figure 13:
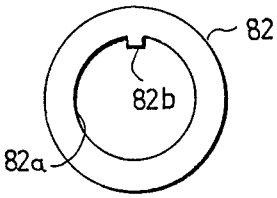
FIG. 13 illustrates one of the spacing washers in the door locking device of FIGS. 1–3.

The code discs 30, 32 are spaced from each other and from interposer 60 by washers 82. FIG. 13 illustrates the construction of one of the washers 82 wherein it will be seen that it is formed with an opening **82*a* of the outer diameter of spindle 52, and with a rib 82*b*** adapted to be received within a recess formed in the spindle for non-rotatably mounting the washer on the spindle.

The assembly on spindle 52 further includes a retainer ring 84 (FIG. 4) on the outer end of spindle 52.

Figure 14:
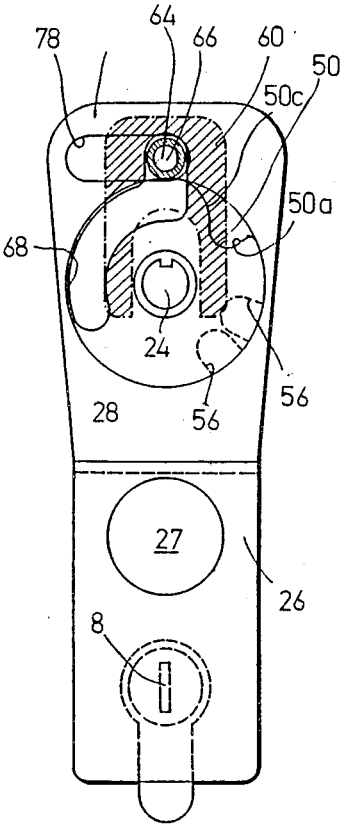
FIGS. 14, 15 and 16 illustrate the guard plate in three positions during the operation of the device, namely: in its raised blocking position; in the same raised position but just before moving downwardly to its unblocking position; and in its lowered unblocking position.

The illustrated protective device is applied to the outer face of door 4 by fasteners 10, with the door lock cylinder 6 received within opening 22 of the rear cover plate 14, and with opening 20 in the front cover plate 16 aligned with the lock cylinder. In the normal condition of the device, the two code discs 30, 32 would be in random positions, and thererfore pin 64 of the interposer would rest against the outer (unnotched) surfaces of the code discs 30, 32. In this position, pin 64 would therefore not be seated within notch 50 of drive disc 8. Accordingly, the guard plate 26 would be in its upper position wherein its window opening 27 is above the keyhole 8 of the lock cylinder 6 so that the lower section **26*b* of the guard plate blocks access to the keyhole. This is the condition of the parts illustrated in FIG. 14**.

When it is desired to unblock access to the keyhole, it is necessary to rotate knob 24 first to two predetermined positions as determined by the settings of presettable members 80 on their respective code discs 30, 32. Thus, when knob 24 is rotated in one direction, its setting pin 48 engages the out-turned arm section **80*b* of presettable member 80 of code disc 30, and therefore rotates code disc 30 with it. Projection 80*d* (FIG. 4) of presettable member 80 on code disc 30 engages arm 80*b* of presettable member 80 on code disc 32**, and thereby also rotates that code disc with it.

When knob 24 is rotated in the opposite direction, both code discs 32, 30 remain at the end positions of the knob until the knob has made a complete revolution wherein its pin 48 then engages the opposite side of presettable member 80 of code disc 30, and thereby rotates the code disc in the opposite direction, while code disc 32 remains in the same position to which it was moved by the previous rotation of the knob. Code disc 30 will then be moved by knob 24 until the knob again reverses direction.

Figure 15:
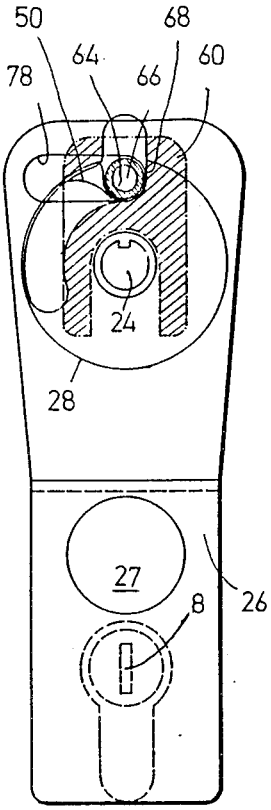

Now, if the above two rotary movements of the knob 24 were exactly according to the predetermined code, both of the code discs 30, 32 will have been rotated such that their notches 56 are aligned with each other. As soon as drive disc 28, rotated by knob 24, aligns its notch 50 with the two notches 56 of the code discs 30, 32, pin 64 will drop into notch 50 of the drive disc 28. This is the condition illustrated in FIG. 15, wherein it will be seen that pin 64 has dropped into the two notches 56 of the code discs 30, 32, and notch 50 of the drive disc 28. This downward movement of pin 64, is accommodated by linear section 68*a* of slot 68 (FIG. 5) in the rear cover plate 14 receiving pin 66 (FIG. 10) of interposer 60, so that the interposer moves downwardly to the bottom of the straight slot section 68*a*. This movement of the interposer is also accommodated by its slot 62 straddling spindle 52 rotatably mounting the code discs 30, 32.

Figure 16:
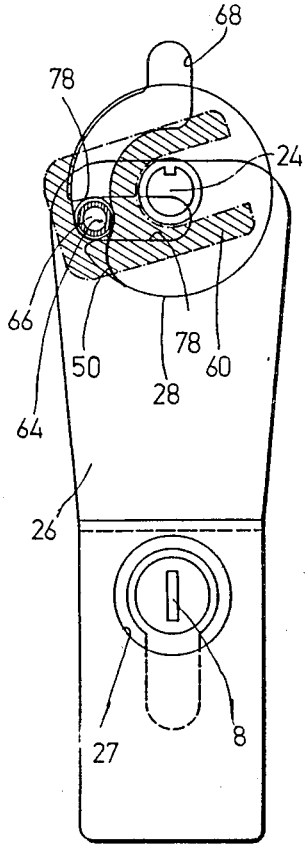

As soon as pin 64 has thus become seated into notch 50 of drive disc 28, the continued rotation of the drive disc by knob 24 pivots interposer 60 about spindle 52, guided by pin 66 (FIG. 10) moving through the curved slot section 68*b* (FIG. 5) of slot 68 in the rear cover plate 14. This pivotable movement of the interposer 60, which is counter-clockwise in FIG. 16, causes its pin 66 to move downwardly. Since this pin is received within horizontal slot 78 of guard plate 26, this movement of the interposer also causes the guard plate to move downwadly, guided by rib 74 formed in the outer face of the rear cover plate 14, until window 27 of the guard plate 26 becomes aligned with lock cylinder 6 so as to provide access to its keyhole 8.

In order to reset the guard plate 26, it is only necessary to rotate knob 24 in the reverse direction, whereupon drive disc 28 will be rotated so as to cause its cam face 50*c* to engage pin 64, thereby raising the pin out of notch 50, and also out of notches 56 of the code discs 30, 32, while continued rotation of the knob rotates the code discs to bring their notches 56 out of alignment with each other.

It will thus be seen that the protective device merely requires the user to rotate the knob 24 to the preselected code positions as determined by the settings of members 80 on their respective code discs 30, 32, and then to continue rotating the knob in order to lower the guard plate 26 to its unblocking position. It will also be seen that whereas the guard plate 26 moves only a slight distance (the length of the straight section 68*a* of slot 68, FIG. 5) when the proper code has been entered this movement is amplified by interposer 60 so as to move the guard plate a sufficient distance to unblock access to the lock keyhole 8. It will also be seen that the predetermined code may be conveniently changed by merely removing the front cover plate 16 to provide access to the presettable members 80 of the code discs 30, 32, and to change their positions by inserting their tips 80*c* into different holes 58 of their respective code discs.

If it is desired to adapt the illustrated protective device to serve also as a night latch, this may easily be done by merely forming a hole through the mounting plate 12, door 4, and the lower end of the guard plate 26, and passing a pin through these aligned holes so as to lock the guard plate in its raised, blocking position, even though the proper combination is introduced via the rotary knob 24.

While the invention has been described with respect to one preferred embodiment, it will be appreciated that many other variations, modifications and applications of the invention may be made.

What is claimed is:

1. A protective device for key-operated door locks, comprising: a housing mountable to the door over the keyhole of a lock mounted within the door; a guard plate movable to a blocking position to block access to said keyhole, or to an unblocking position to permit access to said keyhole; a rotary knob rotatable to a plurality of positions and having markings thereon indicating its position; a transmission mechanism between said rotary knob and said guard plate for moving said guard plate from its blocking position to its unblocking position; said transmission mechanism including at least a first and a second code disc coupleable to said rotary knob such that rotating the rotary knob in one direction positions said first code disc according to the end position of the knob, and then rotating the knob in the opposite direction positions the second code disc according to the end position of the knob; said code discs having notches which are aligned with each other when the discs are in their predetermined code positions; and coupling means comprising an interposer member coupled to said guard plate and having a drive pin receivable in said notches when aligned to couple to interposer member to the rotary knob so as to pivot the interposer member by the further rotation of the knob; said interposer including a second pin received within an opening in the guard plate to move said plate to its unblocking position when the interposer member is pivoted by said rotary knob.

2. The device according to claim 1, wherein said guard plate is coupled at its upper end to said second pin of the interposer, said guard plate having a window opening at its lower end aligned with the keyhole when the guard plate is moved by the interposer to its unblocking position.

3. The device according to claim 1, wherein said housing includes a front cover plate formed with an opening rotatably receiving said knob, and a rear cover plate carrying a spindle on which said code discs are rotatably mounted, said rear cover plate being removably attached to said front cover plate by fasteners to permit removal of said front cover plate and thereby access to said code discs for changing the code thereof.

4. The device according to claim 3, wherein said interposer member is formed with a slot at its lower end receiving said spindle, said interposer member being pivoted about said spindle when coupled to the rotary knob to move the guard plate to its unblocking position.

5. The device according to claim 1, wherein said transmission mechanism further includes a drive disc fixed to said rotary knob so as to be rotated therewith, said drive disc being formed with a notch for receiving said drive pin of the interposer member when the drive pin is received within the aligned notches of the code discs.

6. The device according to claim 5, wherein said notch in the drive disc is formed on one side with a face engageable with said drive pin of the interposer when the drive pin is seated within said notch and the drive disc is rotated in one direction to pivot the interposer about said spindle, said notch in the drive disc being formed on the opposite side with a cam surface effective to move the drive pin out of the notch in the drive disc, and thereby out of the notches in the code discs, when the drive disc is rotated in the opposite direction to thereby reset the interposer member.

7. The device according to claim 5, wherein said second code disc is adjacent to said drive disc, each of said code discs including a presettable member for presetting the code position of the respective disc, said drive disc further including a setting pin engageable with the presettable member of the second code disc when the drive disc is rotated in one direction, the presetting member of the second code disc being engageable with the presetting member of the first code disc when the drive disc and second code disc are rotated in the opposite direction.

8. The device according to claim 7, wherein each of said presetting members comprises a ring rotatably mounted to the center of the respective code disc, and an arm extending radially of its ring and terminating in a down-turned tip receivable in one of a plurality of openings formed around the circumference of its respective code disc.

9. A protective device for key-operated door locks, comprising: a housing mountable to the door over the keyhole of a lock mounted within the door; a guard plate movable to a blocking position to block access to said keyhole, or to an unblocking position to permit access to said keyhole; a rotary knob rotatable to a plurality of positions and having markings thereon indicating its position; and a transmission mechanism between said rotary knob and said guard plate for moving said guard plate from its blocking position to its unblocking position; said transmission mechanism including a plurality of code discs coupleable to said rotary knob such that rotating the rotary knob positions the code discs according to the end positions of the knob; said transmission mechanism further including an interposer member controlled by said code discs and having a drive pin effective to couple said rotary knob to said interposer to pivot same when the code discs have been positioned to predetermined coded positions, said interposer including a second pin received within an opening in the guard plate to move said guard plate to its unblocking position when the interposer member is pivoted by said rotary knob.

10. The device according to claim 9, wherein said code discs have notches which are aligned with each other when the discs are in their predetermined code positions, and said interposer member drive pin is receivable in said notches when aligned to cause the further rotation of the knob to move said guard plate to its unblocking position.

11. The device according to claim 9, wherein said guard plate has a window opening at its lower end aligned with the keyhole when the guard plate is moved by the interposer to its unblocking position.

12. A protective device for key-operated door locks, comprising: a housing mountable to the door over the keyhole of a lock mounted within the door; a guard plate movable to a blocking position to block access to said keyhole, or to an unblocking position to permit access to said keyhole; a rotary knob rotatable to a plurality of positions and having markings thereon indicating its position; and a transmission mechanism between said rotary knob and said guard plate for moving said guard plate from its blocking position to its unblocking position; said transmission mechanism including at least a first and a second code disc coupleable to said rotary knob such that rotating the rotary knob in one direction positions said first code disc according to the end position of the knob, and then rotating the knob in the opposite direction positions the second code disc according to the end position of the knob; said transmission mechanism further including coupling means controlled by said code discs and effective to couple said guard plate to said rotary knob when the code discs have been positioned to predetermined coded positions such that further rotation of the knob moves said guard plate from its blocking position to its unblocking position; said housing including a front cover plate formed with an opening rotatably receiving said knob, and a rear cover plate carrying a spindle on which said code discs are rotatably mounted, said rear cover plate being removably attached to said front cover plate by fasteners to permit removal of said front cover plate and thereby to permit access to said code discs for changing the code thereof, said interposer member being formed with a slot at its lower end receiving said spindle, and being pivoted about said spindle when coupled to the rotary knob to move the guard plate to its unblocking position.

13. The device according to claim 12, wherein said code discs have notches which are aligned with each other when the discs are in their predetermined code positions, and said coupling means comprises an interposer member coupled to said guard plate and having a drive pin receivable in said notches when aligned to cause the further rotation of the knob to move said guard plate to its unblocking position.

14. The device according to claim 13, wherein said transmission further includes a drive disc fixed to said rotary knob so as to be rotated therewith, said drive disc being formed with a notch for receiving said drive pin of the interposer member when the drive pin is received within the aligned notches of the code discs; and wherein said notch in the drive disc is formed on one side with a face engageable with said drive pin of the interposer when the drive pin is seated within said notch and the drive disc is rotated in one direction to pivot the interposer about said spindle, said notch in the drive disc being formed on the opposite side with a cam surface effective to move the drive pin out of the notch in the drive disc, and thereby out of the notches in the code discs, when the drive disc is rotated in the opposite direction to thereby reset the interposer member.

15. The device according to claim 13, wherein said first code disc is adjacent to said drive disc, each of said code discs including a presettable member for presetting the code position of the respective disc, said drive disc further including a setting pin engageable with the presettable member of the first code disc when the drive disc is rotated in one direction, the presetting member of the first code disc being engageable with the presetting member of the second code disc when the drive disc and first code disc are rotated in the opposite direction.

16. The device according to claim 15, wherein each of said presetting members comprises a ring rotatably mounted to the center of the respective code disc, and an arm extending radially of its ring and terminating in a down-turned tip receivable in one of a plurality of openings formed around the circumference of its respective code disc.

* * * * *